US005306313A

United States Patent [19]

Emert et al.

[11] Patent Number: 5,306,313

[45] Date of Patent: Apr. 26, 1994

[54] DISPERSANT ADDITIVE COMPRISING THE REACTION PRODUCT OF A POLYANHYDRIDE AND A MANNICH CONDENSATION PRODUCT

[75] Inventors: Jacob Emert, Brooklyn, N.Y.; Antonio Gutierrez, Mercerville; Robert D. Lundberg, Bridgewater, both of N.J.

[73] Assignee: Exxon Chemical Patents Inc., Linden, N.J.

[21] Appl. No.: 99,085

[22] Filed: Jul. 29, 1993

Related U.S. Application Data

[60] Division of Ser. No. 961,051, Oct. 14, 1992, Pat. No. 5,259,968, which is a continuation of Ser. No. 681,635, Apr. 3, 1991, abandoned, which is a continuation of Ser. No. 162,282, Feb. 29, 1988, abandoned.

[51] Int. Cl.[5] ..... C10L 1/22

[52] U.S. Cl. ..... 44/386; 44/415; 44/419

[58] Field of Search ..... 44/386, 415, 419

[56] References Cited

U.S. PATENT DOCUMENTS

| | | | |
|---|---|---|---|
| 3,360,904 | 12/1967 | Musser et al. | 252/51.5 |
| 3,442,808 | 5/1969 | Traise et al. | 252/51.5 A |
| 3,493,520 | 2/1970 | Verdol et al. | 252/51.5 A |
| 3,558,743 | 1/1971 | Verdol et al. | 260/848 |
| 3,701,640 | 10/1972 | Lease et al. | 44/419 |
| 3,787,458 | 1/1974 | Piasek et al. | 252/51.5 A |
| 3,793,202 | 2/1974 | Piasek et al. | 252/51.5 A |
| 3,798,247 | 3/1974 | Piasek et al. | 252/51.5 A |
| 3,803,039 | 4/1974 | Piasek et al. | 252/51.5 A |
| 4,142,980 | 3/1979 | Karll et al. | 252/51.5 A |
| 4,231,759 | 11/1980 | Udelhofen et al. | 44/415 |
| 4,234,435 | 11/1980 | Meinhardt et al. | 252/51.5 A |
| 4,242,212 | 12/1980 | Hanson | 44/415 |
| 4,248,725 | 2/1981 | Crawford et al. | 252/51.5 A |
| 4,428,849 | 12/1984 | Wistosky | 252/33.4 |
| 4,517,104 | 6/1985 | Bloch et al. | 252/51.5 |
| 4,548,724 | 10/1985 | Karol et al. | 252/51.5 |
| 4,663,064 | 5/1987 | Nalesnik et al. | 252/51.5 |
| 4,713,189 | 12/1987 | Nalesnik et al. | 252/51.5 A |
| 4,747,964 | 5/1988 | Durand et al. | 252/51.5 |
| 4,940,552 | 7/1990 | Cengel et al. | 252/51.5 A |
| 4,986,924 | 1/1991 | Germanaud et al. | 252/51.5 A |
| 5,039,307 | 8/1991 | Herbstman et al. | 44/347 |
| 5,102,570 | 4/1992 | Migdal et al. | 252/51.5 A |
| 5,122,161 | 6/1992 | Benfaremo et al. | 44/348 |
| 5,160,649 | 11/1992 | Cardis et al. | 252/51.5 A |
| 5,182,038 | 1/1993 | Shirodkar et al. | 252/51.5 A |

FOREIGN PATENT DOCUMENTS

| | | |
|---|---|---|
| 0213027 | 3/1987 | European Pat. Off. . |
| 0311319 | 4/1989 | European Pat. Off. . |
| 0486835A1 | 5/1992 | European Pat. Off. . |
| 2053800 | 5/1971 | Fed. Rep. of Germany . |
| 1559643 | 3/1969 | France . |
| 1121681 | 2/1971 | United Kingdom . |
| 2116583 | 9/1983 | United Kingdom . |

*Primary Examiner*—Jerry D. Johnson
*Attorney, Agent, or Firm*—V. T. White

[57] ABSTRACT

A composition of matter useful as an oleaginous composition dispersant additive comprising the reaction product of:

(1) at least one nitrogen or ester containing adduct selected from the group consisting of (i) oil soluble salts, amides, imides, oxazolines, esters, or mixtures thereof of long chain hydrocarbyl substituted mono and dicarboxylic acids or their anhydrides, (ii) long chain hydrocarbyl having a polyamine attached directly thereto, and (iii) Mannich condensation product formed by condensing long chain hydrocarbyl substituted hydroxy aromatic compound with an aldehyde and polyamine, said adduct containing at least one reactive group selected from reactive amino groups and reactive hydroxyl groups; and (2) at least one polyanhydride.

Also disclosed are oleaginous compositions, particularly lubricating oil compositions, containing said reaction product.

8 Claims, No Drawings

DISPERSANT ADDITIVE COMPRISING THE REACTION PRODUCT OF A POLYANHYDRIDE AND A MANNICH CONDENSATION PRODUCT

This is a division of application Ser. No. 961,051, filed Oct. 14, 1992, now U.S. Pat. No. 5,259,968, which is a Rule 62 continuation of U.S. Ser. No. 681,635, filed Apr. 3, 1991, now abandoned, which is a Rule 62 continuation of U.S. Ser. No. 162,282, now abandoned.

FIELD OF THE INVENTION

This invention relates to oil soluble dispersant additives useful in fuel and lubricating oil compositions including concentrates containing said additives, and methods for their manufacture and use. The dispersant additives of the instant invention are comprised of the reaction products of (1) nitrogen or ester containing adduct and (2) polyanhydride.

BACKGROUND OF THE INVENTION

Multigrade lubricating oils typically are identified by two numbers such as 10W30, 5W30 etc. The first number in the multigrade designation is associated with a maximum low temperature (e.g. −20° C.) viscosity requirement for that multigrade oil as measured typically by a cold cranking simulator (CCS) under high shear, while the second number in the multigrade designation is associated with a minimum high temperature (e.g. 100° C.) viscosity requirement. Thus, each particular multigrade oil must simultaneously meet both strict low and high temperature viscosity requirements in order to qualify for a given multigrade oil designation. Such requirements are set e.g., by ASTM specifications. By "low temperature" as used herein is meant temperatures of typically from about −30° to about −5° C. By "high temperature" as used herein is meant temperatures of typically at least about 100° C.

The minimum high temperature viscosity requirement, e.g. at 100° C., is intended to prevent the oil from thinning out too much during engine operation which can lead to excessive wear and increased oil consumption. The maximum low temperature viscosity requirement is intended to facilitate engine starting in cold weather and to ensure pumpability, i.e., the cold oil should readily flow or slump into the well for the oil pump, otherwise the engine can be damaged due to insufficient lubrication.

In formulating an oil which efficiently meets both low and high temperature viscosity requirements, the formulator may use a single oil of desired viscosity or a blend of two lubricating oils of different viscosities, in conjunction with manipulating the identity and amount of additives that must be present to achieve the overall target properties of a particular multigrade oil including its viscosity requirements.

The natural viscosity characteristic of a lubricating oil is typically expressed by the neutral number of the oil (e.g. S150N) with a higher neutral number being associated with a higher natural viscosity at a given temperature. In some instances the formulator will find it desirable to blend oils of two different neutral numbers, and hence viscosities, to achieve an oil having a viscosity intermediate between the viscosity of the components of the oil blend. Thus, the neutral number designation provides the formulator with a simple way to achieve a desired base oil of predictable viscosity. Unfortunately, merely blending oils of different viscosity characteristics does not enable the formulator to meet the low and high temperature viscosity requirements of multigrade oils. The formulator's primary tool for achieving this goal is an additive conventionally referred to as a viscosity index improver (i.e., V.I. improver).

The V.I. improver is conventionally an oil-soluble long chain polymer. The large size of these polymers enables them to significantly increase Kinematic viscosities of base oils even at low concentrations. However, because solutions of high polymers are non-Newtonian they tend to give lower viscosities than expected in a high shear environment due to the alignment of the polymer. Consequently, V.I. improvers impact (i.e., increase) the low temperature viscosities (i.e. CCS viscosity) of the base oil to a lesser extent than they do the high temperature viscosities. Accordingly, constraints are placed on the amount of V.I. improver which a formulator can employ for a given oil blend in order to meet the low and high temperature viscosity requirements of a target multigrade oil.

The aforesaid viscosity requirements for a multigrade oil can therefore be viewed as being increasingly antagonistic at increasingly higher levels of V.I. improver. For example, if a large quantity of V. I. improver is used in order to obtain high viscosity at high temperatures, the oil may now exceed the low temperature requirement. In another example, the formulator may be able to readily meet the requirement for a 10W30 oil but not a 5W30 oil, with a particular ad-pack (additive package) and base oil. Under these circumstances the formulator may attempt to lower the viscosity of the base oil, such as by increasing the proportion of low viscosity oil in a blend, to compensate for the low temperature viscosity increase induced by the V.I. improver, in order to meet the desired low and high temperature viscosity requirements. However, increasing the proportion of low viscosity oils in a blend can in turn lead to a new set of limitations on the formulator, as lower viscosity base oils are considerably less desirable in diesel engine use than the heavier, more viscous oils.

Further complicating the formulator's task is the effect that dispersant additives can have on the viscosity characteristics of multigrade oils. Dispersants are frequently present in quality oils such as multigrade oils, together with the V.I. improver. The primary function of a dispersant is to maintain oil insolubles, resulting from oxidation during use, in suspension in the oil thus preventing sludge flocculation and precipitation. Consequently, the amount of dispersant employed is dictated and controlled by the effectiveness of the material for achieving its dispersant function. A typical U.S. Service Station commercial oil contains from three to four times as much dispersant as V.I. improver (as measured by the respective dispersant and V.I. improver active ingredients). In addition to dispersancy, conventional dispersants can also increase the low and high temperature viscosity characteristics of a base oil simply by virtue of their polymeric nature. In contrast to the V.I. improver, the dispersant molecule is much smaller. Consequently, the dispersant is much less shear sensitive, thereby contributing more to the low temperature CCS viscosity (relative to its contribution to the high temperature viscosity of the base oil) than a V.I. improver. Moreover, the smaller dispersant molecule contributes much less to the high temperature viscosity of the base oil than the V.I. improver. Thus, the magnitude of the low temperature viscosity increase induced by the dispersant can exceed the low temperature viscosity increase induced by the V.I. improver without the benefit of a proportionately greater increase in high temperature viscosity as obtained from a V.I. improver. Consequently, as the dispersant induced low temperature viscosity increase causes the low temperature viscosity of the oil to approach the maximum low temperature viscosity limit, the more difficult it is to introduce a sufficient amount of V.I. improver effective to meet the high temperature viscosity requirement and still meet the low temperature viscosity requirement. The formulator is thereby once again forced to shift to the undesirable expedient of using higher proportions of low viscosity oil to permit addition of the requisite amount of V.I. improver without exceeding the low temperature viscosity limit.

In accordance with the present invention, dispersants are provided which have been found to possess inherent characteristics such that they contribute considerably less to low temperature viscosity increases than dispersants of the prior art while achieving similar or greater high temperature viscosity increases. Moreover, as the concentration of dispersant in the base oil is increased, this beneficial low temperature viscosity effect becomes increasingly more pronounced relative to conventional dispersants. This advantage is especially significant for high quality heavy duty diesel oils which typically require high concentrations of dispersant additive. Furthermore, these improved viscosity properties facilitate the use of V.I. improvers in forming multigrade oils spanning a wider viscosity requirement range, such as 5W30 oils, due to the overall effect of lower viscosity increase at low temperatures while maintaining the desired viscosity at high temperatures as compared to the other dispersants. More significantly, these viscometric properties also permit the use of higher viscosity base stocks with attendant advantages in engine performance. Furthermore, the utilization of the dispersant additives of the instant invention allows a reduction in the amount of V.I. improvers required.

The materials of this invention are thus an improvement over conventional dispersants because of their effectiveness as dispersants coupled with enhanced low temperature viscometric properties. These materials are particularly useful with V.I. improvers in formulating multigrade oils.

U.S. Pat. No. 4,548,724 discloses dispersant additives for use in lubricating oils formed by the reaction of polyacids and polyisobutenyl succinimide of a polyamine. The polyacids are organic polycarboxylic acids represented by the formula $$R^*(COOH)_x$$

wherein x is an integer of 3–6, preferably 3, and R* is a x valent hydrocarbon radical. This patent teaches that because of the fact that each reactant contains a plurality of reacting groups, the resulting product may not be a single compound but will undoubtedly include compounds containing an intricate network of products formed as a result of different amine groups of one molecule of succinimide bonding with a carboxyl group on different molecules of acid and different carboxyl groups of one molecule of acid bonding with an amine group on different molecules of succinimide. However, in the instant invention because the anhydride moiety is relatively more reactive with the secondary amino moiety than the carboxyl moiety, the formation of the compounds of the instant invention proceeds more rapidly and at less extreme reaction conditions than that using the polyacid. The use of a polyanhydride offers the further advantage that after reaction of the polyanhydride such as a bis-anhydride there is left a dicarboxylic acid moiety for still further reaction with the reactive amino groups.

SUMMARY OF THE INVENTION

The present invention is directed to oil soluble dispersants useful in oleaginous compositions selected from fuels and lubricating oils comprising nitrogen or ester containing adducts which are post-reacted with at least one polyanhydride. The nitrogen or ester containing adducts which are reacted with the polyanhydride to produce the dispersants of the instant invention comprise members selected from the group consisting of (i) oil soluble salts, amides, imides, oxazolines and esters, or mixtures thereof, of long chain hydrocarbon substituted mono and dicarboxylic acids on their anhydrides, (ii) long chain aliphatic hydrocarbon having a polyamine attached directly thereto; and (iii) Mannich condensation products formed by condensing a long chain hydrocarbon substituted hydroxy aromatic material such as a phenol with an aldehyde such as formaldehyde and a polyamine.

DETAILED DESCRIPTION OF THE INVENTION

In accordance with the present invention there are provided oil soluble dispersant compositions. These dispersants exhibit a high temperature to low temperature viscosity balance or ratio which is more favorable than that of conventional dispersant materials. That is to say the instant dispersant materials possess inherent characteristics such that they contribute less to low temperature viscosity increase than conventional dispersants while increasing the contribution to the high temperature viscosity increase.

The improved dispersants of the instant invention are comprised of the oil soluble reaction products of:

(I) nitrogen or ester containing adducts selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; and (iii) Mannich condensation products formed by condensing a long chain hydrocarbon substituted hydroxy aromatic material such as a phenol with an aldehyde such as formaldehyde and a polyamine, wherein said long chain hydrocarbon group in (i) (ii) and (iii) is a polymer of a $C_2$ to $C_{18}$, e.g., $C_2$ to $C_5$ monoolefin, said polymer having a number average molecular weight of about 500 to about 6000; and (II) a polyanhydride.

The molecular weight of the product is increased by the coupling or linking of two or more molecules of the adduct by or through the polyanhydride moieties.

One aspect of the present invention is a dispersant comprised of the reaction products of (A) a nitrogen containing adduct comprising the reaction products of a long chain hydrocarbon substituted dicarboxylic acid material and a polyamine, and (B) a polyanhydride.

Another aspect of the present invention is a dispersant comprised of the reaction products of (C) an ester containing adduct comprising the reaction products of a long chain hydrocarbon substituted dicarboxylic acid material and hydroxy compounds such as polyols, and (B) a polyanhydride.

Still another aspect of the present invention is a dispersant comprised of the reaction products of (D) a nitrogen containing adduct comprising a Mannich condensation product, and (B) a polyanhydride.

Yet a further aspect of the present invention is a dispersant comprised of the reaction products of (E) a nitrogen containing adduct comprising a long chain aliphatic hydrocarbon having a polyamine attached directly thereto, and (B) a polyanhydride.

THE LONG CHAIN HYDROCARBYL SUBSTITUTED DICARBOXYLIC ACID MATERIAL

The long chain hydrocarbyl substituted dicarboxylic acid producing material, e.g., acid, anhydride, or ester, used in the invention includes a long chain hydrocarbon substituted typically with an average of at least about 0.7, usefully from about 0.6–2.0 (e.g. 0.9–1.6), preferably about 1.0 to 1.3 (e.g. 1.1–1.2) moles, per mole of hydrocarbon, of a $C_4$ to $C_{10}$ dicarboxylic acid, anhydride or ester thereof, such as succinic acid, succinic anhydride, glutaric acid, methylsuccinic acid, etc., and mixtures thereof.

The hydrocarbyl substituted dicarboxylic acid materials, as well as methods for their preparation, are well known in the art and are amply described in the patent literature. They may be obtained, for example, by the Ene reaction between a polyolefin and an alpha-beta unsaturated $C_4$ to $C_{10}$ dicarboxylic acid, anhydride or ester thereof, such as fumaric acid, itaconic acid, maleic acid, maleic anhydride, chloromaleic acid, dimethyl fumarate, etc.

The hydrocarbyl substituted dicarboxylic acid materials function as acylating agents for the nitrogen containing moiety, e.g., polyamine, to form the acylated nitrogen derivatives of hydrocarbyl substituted dicarboxylic acids, anhydrides, or esters which are subsequently reacted with the polyanhydrides to form the dispersants of the present invention.

Preferred olefin polymers for reaction with the unsaturated dicarboxylic acid, anhydride, or ester are polymers comprising a major molar amount of $C_2$ to $C_{18}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; isobutylene and styrene; etc. other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have number average molecular weights within the range of about 500 and about 6000, e.g., 700 to 3000, preferably between about 800 and about 2500. An especially useful starting material for a highly potent dispersant additive made in accordance with this invention is polyisobutylene.

Processes for reacting the olefin polymer with the $C_4$–$C_{10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Alternatively, the olefin polymer can be first halogenated, for example, chlorinated or brominated to about 1 to 8 wt. %, preferably 3 to 7 wt. % chlorine or bromine, based on the weight of polymer, by passing the chlorine or bromine through the polyolefin at a temperature of 60 to 250° C., e.g., 120 to 160° C. for about 0.5 to 10, preferably 1 to 7 hours. The halogenated polymer may then be reacted with sufficient unsaturated acid or anhydride at 100 to 250° C., usually about 180 to 220° C., for about 0.5 to 10 hours, e.g. 3 to 8 hours, so the product obtained will contain an average of about 0.6 to 2.0 moles, preferably 1.0 to 1.3 moles, e.g., 1.2 moles, of the unsaturated acid per mole of the halogenated polymer. Processes of this general type are taught in U.S. Pat. Nos. 3,087,436; 3,172,892; 3,272,746 and others.

Alternatively, the olefin polymer and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. polyisobutylene, will normally react with the dicarboxylic acid material. Upon carrying out a thermal reaction without the use of halogen or a catalyst, then usually only about 50 to 85 wt. % of the polyisobutylene will react. Chlorination helps increase the reactivity. For convenience, all of the aforesaid functionality ratios of dicarboxylic acid producing units to polyolefin, e.g. 1.0 to 2.0, etc. are based upon the total amount of polyolefin, that is, the total of both the reacted and unreacted polyolefin, present in the resulting product formed in the aforesaid reactions.

THE AMINE COMPOUNDS

Amine compounds useful as reactants with the hydrocarbyl substituted dicarboxylic acid material, i.e., acylating agent, are those containing at least two reactive amino groups, i.e. , primary and secondary amino groups. They include polyalkylene polyamines, of about 2 to 60 (e.g. 2 to 30) , preferably 2 to 40, (e.g. 3 to 20) total carbon atoms and about 1 to 12 (e.g., 2 to 9) , preferably 3 to 12, and most preferably 3 to 9 nitrogen atoms in the molecule. These amines may be hydrocarbyl amines or may be hydrocarbyl amines including other groups, e.g, hydroxy groups, alkoxy groups, amide groups, nitriles, imidazoline groups, and the like. Hydroxy amines with 1 to 6 hydroxy groups, preferably 1 to 3 hydroxy groups are particularly useful. Such amines should by capable of reacting with the acid or anhydride groups of the hydrocarbyl substituted dicarboxylic acid moiety and with the oxirane rings of the dianhydride moiety through the amino functionality or a substituent group reactive functionality. Since tertiary amines are generally unreactive with anhydrides and oxirane rings, it is desirable to have at least two primary and/or secondary amino groups on the amine. It is preferred that the amine contain at least one primary amino group, for reaction with the acid or anhydride groups of the hydrocarbyl substituted dicarboxylic acid moiety, and at least one secondary amino group, for reaction with the anhydride groups of the dianhydride moiety. Preferred amines are aliphatic saturated amines, including those of the general formulae

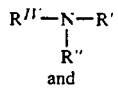

(I)

and

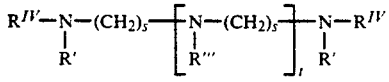

(Ia)

wherein $R^{IV}$, R', R'', and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' and R'' can additionally comprise a moiety of the formula

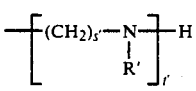

(Ib)

wherein R', is as defined above, and wherein each s and s', can be the same or a different number of from 2 to 6, preferably 2 to 4; and t and t', can be the same or different and are each numbers of typically from 0 to 10, preferably about 2 to 7, most preferably about 3 to 7, with the proviso that t+t', is not greater than 10. To assure a facile reaction it is preferred that R', R'', R''', $R^{IV}$ S, s', t and t' be selected in a manner sufficient to provide the compounds of formula I or Ia with typically at least two primary or secondary amine groups. This can be achieved by selecting at least one of said R', R'', R''' or $R^{IV}$, groups to be hydrogen or by letting t in formula I be at least one when R''' is H or when the Ib moiety possesses a secondary amino group. The most preferred amines of the above formulas are represented by formula Ia and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene)triamine; N,N-dimethyl-1,3-diaminopropane;; N,N'-di-(2-aminoethyl) ethylene diamine; 3-dodecylpropylamine; N-dodecyl-1,3-propane dismine; mono-, di-, and tri-tallow amines; amino morpholines such as N-(3-aminopropyl) morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula:

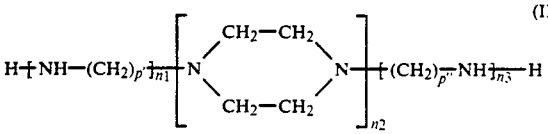

(II)

wherein p' and p'' are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; and mixtures thereof.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly (ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

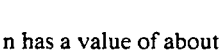

(III)

where m has a value of about 3 to 70 and preferably 10 to 35; and

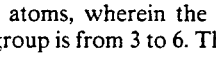

(IV)

where n has a value of about 1 to 40, with the provision that the sum of all the n's is from about 3 to about 70, and preferably from about 6 to about 35, and $R_1$ is a substituted saturated hydrocarbon radical of up to 10 carbon atoms, wherein the number of substituents on the R group is from 3 to 6. The alkylene groups in either formula (III) or (IV) may be straight or branched chains containing about 2 to 7, and preferably about 2 to 4 carbon atoms.

The polyoxyalkylene polyamines of formulae (III) or (IV) above, preferably polyoxyalkylene diamines and polyoxyalkylene triamines, may have number average molecular weights ranging from about 200 to about 4000 and preferably from about 400 to about 2000. The pref erred polyoxyalkylene polyamines include the polyoxyethylene and polyoxypropylene diamines and the polyoxypropylene triamines having average molecular weights ranging f rom about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The amine is readily reacted with the dicarboxylic acid material, e.g. alkenyl succinic anhydride, by heating an oil solution containing 5 to 95 wt. % of dicarboxylic acid material to about 100 to 200° C., preferably 125 to 175° C., generally for 1 to 10, e.g. 2 to 6 hours until the desired amount of water is removed. The heating is preferably carried out to favor formation of imides or mixtures of imides and amides, rather than amides and salts. Reaction ratios of dicarboxylic acid material to equivalents of amine as well as the other nucleophilic reactants described herein can vary considerably, depending upon the reactants and type of bbnds formed. Generally from 0.1 to 1.0, preferably about 0.2 to 0.6, e.g. 0.4 to 0.6, moles of dicarboxylic acid moiety content (e.g. grafted maleic anhydride content) is used, per equivalent of nucleophilic reactant, e.g. amine. For example, about 0.8 mole of a pentamine (having two primary amino groups and 5 equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e. preferably the pentamine is used in an amount sufficient to provide about 0.4 mole (that is $1.6/[0.8\times5]$ mole) of succinic anhydride moiety per nitrogen equivalent of the amine.

THE HYDROXY COMPOUNDS

The adducts may also be esters derived from the aforesaid long chain hydrocarbon substituted dicarboxylic acid material and from hydroxy compounds such as polyhydric alcohols or aromatic compounds such as phenols and naphthols, etc. The polyhydric alcohols are the most preferred hydroxy compounds. Suitable polyol compounds which can be used include aliphatic polyhydric alcohols containing up to about 100 carbon atoms and about 2 to about 10 hydroxyl groups. These alcohols can be quite diverse in structure and chemical composition, for example, they can be substituted or unsubstituted, hindered or unhindered, branched chain or straight chain, etc. as desired. Typical alcohols are alkylene glycols such as ethylene glycol, propylene glycol, trimethylene glycol, butylene glycol, and polyglycol such as diethylene glycol, triethylene glycol, tetraethylene glycol, dipropylene glycol, tripropylene glycol, dibutylene glycol, tributylene glycol, and other alkylene glycols and polyalkylene glycols in which the alkylene radical contains from two to about eight carbon atoms. Other useful polyhydric alcohols include glycerol, monomethyl ether of glycerol, penthaerythritol, dipentaerythritol, tripentaerythritol, 9,10-dihydroxystearic acid, the ethyl ester of 9,10-dihydroxystearic acid, 3-chloro-1, 2 propanediol, 1,2 butanediol, 1,4-butanediol, 2,3 hexanediol, 2,3-hexanediol, pinacol, tetrahydroxy pentane, erythritol, arabitol, sorbitol, mannitol, 1,2-cyclohexanediol, 1,4-cyclohexanediol, 1,4-(2 hydroxyethyl)-cyclohexane, 1,4-dihydroxy-2-nitrobutane, 1,4-di-(2-hydroxyethyl)-benzene, the carbohydrates such as glucose, mannose, glyceraldehyde, and galactose, and the like.

Included within the group of aliphatic alcohols are those alkane polyols which contain ether groups such as polyethylene oxide repeating units, as well as those polyhydric alcohols containing at least three hydroxyl groups, at least one of which has been esterified with a mono-carboxylic acid having from eight to about 30 carbon atoms such as octanoic acid, oleic acid, stearic acid, linoleic acid, dodecanoic acid, or tall oil acid. Examples of such partially esterified polyhydric alcohols are the mono-oleate of sorbitol, the mono-oleate of glycerol, the mono-stearate of glycerol, the di-stearate of sorbitol, and the di-dodecanoate of erythritol.

A preferred class of ester containing adducts are those prepared from aliphatic alcohols containing up to 20 carbon atoms, and especially those containing three to 15 carbon atoms. This class of- alcohols includes glycerol, erythritol, pentaerythritol, dipentaerythritol, tripentaerythritol, gluconic acid, glyceraldehyde, glucose, arabinose, 1,7-heptanediol, 2,4 heptanediol, 1,2,3-hexanetriol, 1,2,4-hexanetriol, 1,2,5-hexanetriol, 2,3,4-hexanetriol, 1,2,3 butanetriol, 1,2,4-butanetriol, quinic acid, 2,2,6,6 tatrakis(hydroxymethyl)-cyclohexanol, 1,10 decanediol, digitalose, and the like. The esters prepared from aliphatic alcohols containing at least three hydroxyl groups and up to fifteen carbon atoms are particularly preferred.

An especially preferred class of polyhydric alcohols for preparing the ester adducts used as starting materials in the present invention are the polyhydric alkanols containing three to 15, especially three to six carbon atoms and having at least three hydroxyl groups. Such alcohols are exemplified in the above specifically identified alcohols and are represented by glycerol, erythritol, pentaerythritol, mannitol, sorbitol, 1,2,4 hexanetriol, and tetrahydroxy pentane and the like.

The ester adducts may be diesters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester adducts may be prepared by one of several known methods as illustrated for example in U.S. Pat. No. 3,381,022. The ester adducts may also be borated, similar to the nitrogen containing adducts, as described herein.

HYDROXYAMINE COMPOUNDS

In addition to the aforedescribed polyamines and polyols which can be reacted with the long chain hydrocarbon substituted dicarboxylic acid materials to form the adducts of this invention, hydroxyamines may also be reacted with these acid materials to form the adducts useful herein. Hydroxyamines which can be reacted with the aforesaid long chain hydrocarbon substituted dicarboxylic acid material to form adducts include 2-amino-l-butanol, 2-amino-2-methyl-1-propanol, p-(beta-hydroxyethyl)-aniline, 2-amino-l-propanol, 3-amino-i-propanol, 2-amino-2-methyl 1,3-propane-diol, 2-amino-2-ethyl-1,3-propanediol, N-(betahydroxypropyl)-N'-(beta-amino-ethyl)Opiperazine, tris(hydroxymethyl) amino-methane (also known as trismethylolaminomethane), 2-amino-l-butanol, ethanolamine, beta-(betahydroxyethoxy)-ethylamine and the like. Mixtures of these or similar amines can also be employed.

Also useful as nitrogen containing adducts which are reacted with the polyanhydride to form the improved dispersants of this invention are the adducts of group (ii) above wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

Another class of nitrogen containing adducts which are reacted with the polyanhydride to produce the dispersants of this invention are the adducts of group (iii) above which contain Mannich base or Mannich condensation products as they are known in the art. Such Mannich condensation products generally are prepared by condensing about 1 mole of a high molecular weight hydrocarbyl substituted hydroxy aromatic material such as mono- or polyhydroxy benzene (e.g., having a number average molecular weight of 1,000 or greater) with about 1 to 2.5 moles of an aldehyde such as formaldehyde or paraformaldehyde and about 0.5 to 2 moles polyamine as disclosed, e.g. in U.S. Pat. Nos. 3,442,808; 3,649,229 and 3,798,165 (the disclosures which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

The hydrocarbyl substituted hydroxy aromatic compounds used in the invention include those compounds having the formula

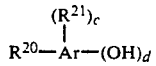

wherein Ar represents

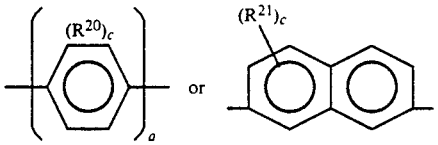

wherein a is 1 or 2, $R^{20}$ is a long chain hydrocarbon $R^{21}$ is a hydrocarbon or substituted hydrocarbon radical having from 1 to about 3 carbon atoms or a halogen radical such as the bromide or chloride radical, f is an integer from 1 to 2, c is an integer from 0 to 2, and d is an integer from 1 to 2.

Illustrative of such Ar groups are phenylene, biphenylene, naphthylene and the like.

The preferred long chain hydrocarbon substituents are olefin polymers comprising a major molar amount of $C_2$ to $C_{18}$, e.g., $C_2$ to $C_5$ monoolefin. Such olefins include ethylene, propylene, butylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. other copolymers include those in which a minor amount of the copolymer monomers, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have a number average molecular weight ($\overline{M}_n$) within the range of about 500 and about 7,000, more usually between about 700 and about 3,000. Particularly useful olefin polymers have a number average molecular weight within the range of about 800 to-about 2500. An especially useful starting material for a highly potent dispersant additive made in accordance with this invention is polyisobutylene. The number average molecular weight for such polymers can be determined by several known techniques. A convenient method f or such determination is by gel permeation chromatography (GPC) which additionally provides molecular weight distribution information, see. W. W. Yau, J. J. Kirkland and D. D. Bly, "Moder Size Exclusion Liquid Chromatography", John Wiley and Sons, New York, 1979.

Processes for substituting the hydroxy aromatic compounds with the olefin polymer are known in the art and may be depicted as follows:

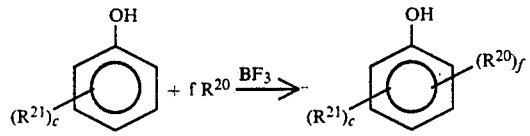

where $R^{21}$, $R^{20}$, f and c are as previously defined, and $BF_3$ is an alkylating catalyst. Processes of this type are described, for example, in U.S. Pat. Nos. 3,539,633 and 3,649,229, the disclosures of which are incorporated herein by reference.

Representative hydrocarbyl substituted hydroxy aromatic compounds contemplated for use in the present invention include, but are not limited to, 2-polypropylene phenol, 3-polypropylene phenol, 4-polypropylene phenol, 2-polybutylene phenol, 3-polyisobutylene phenol, 4-polyisobutylene phenol, 4-polyisobutylene-2-chlorophenol, 4-polyisobutylene-2-methylphenol, and the like.

Suitable hydrocarybl substituted polyhydroxy aromatic compounds include the polyolefin catechols, the polyolefin resorcinols, and the polyolefin hydroquinones, e.g., 4-polyisobutylene-1,2-dihydroxybenzene, 3-polypropylene-1,2-dihydroxy-benzene, 5-polyisobutylene-1,3-dihydroxybenzene, 4-polyamylene-1,3-dihydroxybenzene, and the like.

The preferred long chain hydrocarbyl substituted hydroxy aromatic compounds to be used in this invention can be illustrated by the formula

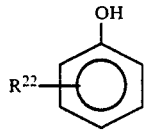

(III)

wherein $R^{22}$ is hydrocarbyl of from 50 to 300 carbon atoms, and preferably is a polyolefin derived from a $C_2$ to $C_{18}$ (e.g., $C_2$ to $C_5$) mono-alpha-olefin.

The aldehyde material which can be employed in this invention is represented by the formula:

$R^{23}CHO$ in which $R^{23}$ is a hydrogen or an aliphatic hydrocarbon radical having from 1 to 4 carbon atoms. Examples of suitable aldehydes include formaldehyde, paraformaldehyde, acetaldehyde and the like.

In a preferred embodiment of the instant invention the adducts which are reacted with the polyanhydride to form the dispersants of this invention are the nitrogen containing adducts of group (i) above, i.e., those derived from a hydrocarbyl substituted dicarboxylic acid forming material (acids or anhydrides) and reacted with polyamines. These types of adducts are nomenclatured, in the specification and claims, as acylated nitrogen derivatives of hydrocarbyl substituted dicarboxylic acid materials, with the hydrocarbyl substituted dicarboxylic acid forming material being nomenclatured as an acylating agent or material. Particularly preferred adducts of this type are those derived from polyisobutylene substituted with succinic anhydride groups and reacted with polyethylene amines, e.g. tetraethylene pentamine, pentaethylene hexamine, polyoxyethylene and polyoxypropylene amines, e.g. polyoxypropylene diamine, trismethylolaminoethane and pentaerythritol, and combinations thereof.

Utilizing this preferred group of nitrogen containing adducts the dispersants of the instant invention may be characterized as acylated nitrogen derivatives of hydrocarbyl substituted dicarboxylic materials comprising the reaction products of:

(A) at least one nitrogen containing adduct comprising the reaction products of (1) a long chain hydrocarbyl substituted dicarboxylic acid producing material, and (2) a polyamine; and (B) a polyanhydride.

The polyanhydrides useful in the instant invention are compounds containing at least two anhydride groups, i.e.,

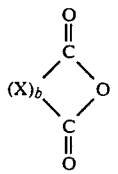

(IV)

wherein X is a tri- or tetravalent hydrocarbon or substituted hydrocarbon radical which will be more particularly defined hereinafter, and b is zero or one. These anhydride groups are connected or joined by a polyvalent hydrocarbon radical, a polyvalent substituted hydrocarbon radical, a polyvalent hydrocarbon radical containing at least one hetero atom or group, or a polyvalent substituted hydrocarbon radical containing at least one hetero atom or group. The polyvalent hydrocarbon radicals generally contain from 1 to about 1,000 carbon atoms, preferably from 2 to about 500 carbon atoms, and more preferably from 2 to about 100 carbon atoms. They may be aliphatic, cycloaliphatic, aromatic, or aliphatic-aromatic. They may be saturated or unsaturated. They may be polymeric or monomeric. The polyvalent substituted hydrocarbon radicals are those polyvalent hydrocarbon radicals described hereinafore containing at least 1, typically from 1 to about 5, substituent groups. The substituent groups are those which are substantially inert or unreactive at ambient conditions with the anhydride group. The term "substantially inert or unreactive at ambient conditions" as used in the specification and appended claims is intended to mean that the atom or group is inert at ambient temperatures and/or pressures to chemical reactions with the anhydride groups so as not to materially interfere in an adverse manner with the preparation and/or functioning of the compositions, additives, compounds, etc. of this invention in the context of its intended use. For example, small amounts of these atoms or groups can undergo minimal reaction with the anhydride without preventing the making and using of the invention as described herein. In other words, such reaction, while technically discernable, would not be sufficient to deter the practical worker of ordinary skill in the art from making and using the invention for its intended purposes.

It is to be understood that while many substituent groups are substantially inert or unreactive at ambient conditions with the anhydride group, they will react with this group under conditions effective for reaction of the anhydride group with the reactive amino groups of the acylated nitrogen derivatives of hydrocarbyl substituted dicarboxylic materials to take place. Whether these groups are suitable substituent groups which can be present on the polyanhydride depends, in part, upon their reactivity with the anhydride group. Generally, if they are substantially more reactive with the anhydride group than the anhydride group is with, for example, the reactive amino group, particularly the secondary amino group, they will tend to materially interfere in an adverse manner with the preparation of the improved dispersants of this invention and are, therefore, unsuitable. If, however, their reactivity with the anhydride group is less than or generally similar to the anhydride group with, for example, the reactive amino groups, they will not materially interfere in an adverse manner with the preparation of the dispersants of the present invention and may be present on the polyanhydride, particularly if the anhydride groups are present in excess anhydride groups are present in excess relative to the substituent groups.

Suitable substituent atoms or groups include, but are not limited to, alkyl groups, ether groups, hydroxyl groups, tertiary amino groups, halogens such as chlorine and bromine, and the like. When more than one substituent group is present they may be the same or different. The polyvalent hydrocarbon radicals containing at least one hetero atom or group are those hydrocarbon radicals described above which contain at least one hetero atom or group in the chain. The hetero atoms or groups are those that are substantially inert or unreactive at ambient conditions with the anhydride groups. When more than one hetero atom or group is present they may be the same or different. These hetero atom or group containing polyvalent hydrocarbon radicals may contain at least one substituent atom or group on at least one carbon atom. These substituent atoms or groups are those described above as suitable for the polyvalent hydrocarbon radicals.

Some illustrative non-limiting examples of suitable hetero atoms or groups include:

oxygen atoms (i.e., —O— or ether linkages in the carbon chain);

sulfer atoms (i.e., —S— or thioether linkages in the carbon chain);

carboxy groups (i.e., $-\overset{O}{\overset{\|}{C}}-O-$);

carbonyl groups (i.e., $-\overset{O}{\overset{\|}{C}}-$);

sulfonyl group (i.e., $-\underset{\underset{O}{\|}}{\overset{O}{\overset{\|}{S}}}-$);

sulfinyl group (i.e., $-\overset{O}{\overset{//}{S}}-$ );

and nitro groups.

It is critical to the present invention that the polyanhydrides contain at least two dicarboxylic acid anhydride moieties on the same molecule. These polyanhydrides may be further characterized as polyanhydrides containing at least two dicarboxylic acid anhydride moieties joined or connected by a hydrocarbon moiety, a substituted hydrocarbon moiety, a hydrocarbon moiety containing at least one hetero atom or group, or a substituted hydrocarbon moiety containing at least one hetero atom or group. These polyanhydrides are well known in the art and are generally commercially available or may be readily prepared by conventional and well known methods.

The polyanhydrides of the instant invention may be represented by the formula

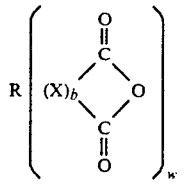

(V)

wherein:

b is 0 or 1;

w is the number of

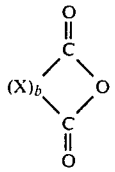

groups present on R, and is at least 2;

X is a q valent aliphatic acyclic hydrocarbon radical or substituted hydrocarbon radical containing from to about 8 carbon atoms which together with the two carbonyl carbon atoms and the oxygen atom forms a cyclic structure, where q is 3 or 4; and R is a z valent hydrocarbon radical, substituted hydrocarbon radical, hydrocarbon radical containing at least one hetero atom or group, or substituted hydrocarbon radical containing at least one hetero atom or group, where z=(q-2)w with the proviso that if b=O then q=4.

In Formula V X is independently selected from aliphatic, preferably saturated, acylic trivalent or tetravalent hydrocarbon radicals or substituted hydrocarbon radicals containing from 1 to about 8 carbon atoms which together with the two carbonyl carbon atoms forms a mono- or divalent cyclic structure. By trivalent or tetravalent hydrocarbon radicals is meant an aliphatic acyclic hydrocarbon, e.g., alkane, which has had removed from its carbon atoms three or four hydrogen atoms respectively. Some illustrative non-limiting examples of these tri- and tetravalent aliphatic acyclic hydrocarbon radicals include:

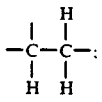

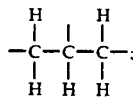

-continued

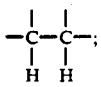

and

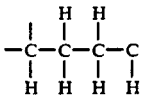

Since two of these valence bonds will be taken up by the two carbonyl carbon atoms there will be left one, in the case of X being trivalent, or two, in the case of X being tetravelent, valence bonds. Thus, if X is a trivalent radical the resulting cyclic structure formed between X and the two carbonyl carbon atoms will be monovalent while if X is a tetravalent radical the resulting cyclic structure will be divalent.

When X is a substituted aliphatic, preferably saturated, acyclic tri- or tetravalent hydrocarbon radical it contains from 1 to about 4 substituent groups on one or more carbon atoms. If more than one substituent group is present they may be the same or different. These substituent groups are those that do not materially interfere in an adverse manner with the preparation and/or functioning of the composition, additives, compounds, etc. of this invention in the context of its intended use. Some illustrative non-limiting examples of suitable substituent groups include alkyl radicals, preferably $C_1$ to $C_5$ alkyl radicals; halogens, preferably chlorine and bromine, and hydroxyl radicals. However, X is preferably unsubstituted.

When b is zero in Formula V the two carbonyl carbon atoms are bonded directly to the R moiety. An illustrative non-limiting example of such a case is cyclohexyl dianhydride; i.e.,

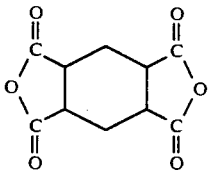

In this cyclohexyl dianhydride R is a tetravalent cycloaliphatic hydrocarbon radical, i.e., z=4, with q=4 since b is zero, and w=2.

In formula V w is an integer of at least 2. The upper limit of w is the number of replaceable hydrogen atoms present on R if b is one and X is a trivalent radical, or one half the number of replaceable hydrogen atoms present on R if b is one and X is a tetravalent radical or if b is zero. Generally, however, w has an upper value not greater than about 10, preferably about 6, and more preferably about 4.

R in Formula V is selected from z valent hydrocarbon radicals, substituted z valent hydrocarbon radicals, z valent hydrocarbon radicals containing at least one hetero atom or group, and z valent substituted hydrocarbon radicals containing at least one hetero atom or group. The hydrocarbon radicals generally contain from 1 to about 100 carbon atoms, preferably from 2 to about 50 carbon atoms and may be aliphatic, either saturated or unsaturated , cycloaliphatic aromatic, or aliphatic-aromatic.

The aliphatic hydrocarbon radicals represented by R are generally those containing from 1 to about 100, preferably 2 to about 50, carbon atoms. They may be straight chain or branched. The cycloaliphatic radicals are preferably those containing from 4 to about 16 ring carbon atoms. They may contain substituent groups, e.g., lower alkyl groups, on one or more ring carbon atoms. These cycloaliphatic radicals include, for example, cycloalkylene, cycloalkylidine, cycloalkanetriyl, and cycloalkanetetrayl radicals. The aromatic radicals are typically those containing from 6 to 12 ring carbon atoms.

It is to be understood that the term "aromatic" as used in the specification and the appended claims is not intended to limit the polyvalent aromatic moiety represented by R to a benzene nucleus. Accordingly it is to be understood that the aromatic moiety can be a pyridine nucleus a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)-methylene linkages, lower alkylene ether linkages, alkylene keto linkages, lower alkylene sulfur linkages, lower alkylene polysulfide linkages of 2 to 6 carbon atoms, amino linkages, and mixtures of such divalent bridging linkages.

When the aromatic moiety, Ar, is, for example, a divalent linked polynuclear aromatic moiety it can be represented by the general formula $$-Ar-(Lng-Ar)_{w'}$$

wherein w' is an integer of 1 to about 10, preferably 1 to about 8, more preferably 1, 2 or 3; Ar is a divalent aromatic moiety as described above, and each Lng is a bridging linkage individually chosen from the group consisting of carbon-to-carbon single bonds, ether linkages (e.g. —Op—), keto linkages (e.g., $$-\overset{O}{\overset{\|}{C}}-),$$

sulfide linkages (e.g., —S—), polysulfide linkages of 2 to 6 sulfur atoms (e.g., —S2-6-), sulfinyl linkages (e.g., —S(O)—), sulfonyl linkages (e.g., —S(O)2—), lower alkylene linkages (e.g., $-CH_2-$, $-CH_2-CH_2$, $$-CH_2-\underset{\underset{R^*}{|}}{CH}-,$$

etc.) di(lower alkyl) —methylene linkages (e.g., $-CR^*_2-$), lower alkylene ether linkages (e.g., $-CH_2-O-$, $-CH_2-O-CH_2-$, $-CH_2-CH_2-O-$, $-CH_2CH_2OCH_2CH_2-$, $$-CH_2\underset{\underset{R^*}{|}}{CHOCH_2}\underset{\underset{R^*}{|}}{CH}- \quad -CH_2\underset{\underset{R^*}{|}}{CHOCH}\underset{\underset{R^*}{|}}{CH_2}-$$

etc.) lower alkylene sulfide linkages (e.g., wherein one or more —O—'s in the lower alkylene ether linkages is replaced with an —S— atom), lower alkylene polysulfide linkages (e.g., wherein one or more —O—'s is replaced with a $-S_2$-group), with R* being a lower alkyl group.

Illustrative of such divalent linked polynuclear aromatic moieties are those represented by the formula

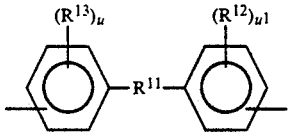

wherein $R^{12}$ and $R^{13}$ are independently selected from hydrogen and alkyl radicals, preferably alkyl radicals containing from 1 to about 20 carbon atoms; $R^{11}$ is selected from alkylene, alkylidene, cycloalkylene, and cycloalkylidene radicals; and u and $u_1$ are independently selected from integers having a value of from 1 to 4.

The aliphatic-aromatic radicals are those containing from to about 50 carbon atoms.

Some illustrative non-limiting examples of polyanhydride include

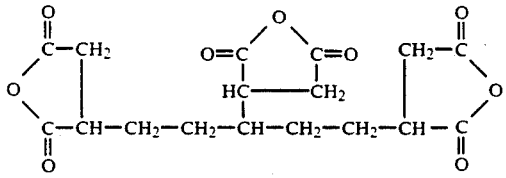

Included within the scope of the polyanhydrides of the instant invention are the dianhydrides. The dianhydrides include those represented by the formula

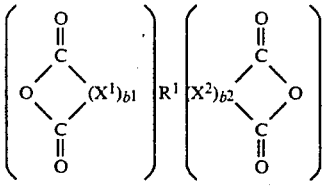

(VI)

wherein:

$b^2$ is 0 or 1;

$b^1$ is 0 or 1;

$X^2$ is a $q^2$ valent aliphatic acyclic hydrocarbon radical or substituted hydrocarbon radical containing from 2 to about 8 carbon atoms which together with the two carbonyl carbon atoms and the oxygen atom forms a cyclic structure, where $q^2$ is 3 or 4;

$X^1$ is a $q^1$ valent aliphatic acyclic hydrocarbon radical or substituted hydrocarbon radical containing from 2 to about 8 carbon atoms which together with the two carbonyl carbon atoms and the oxygen atom forms a cyclic structure, where $q^1$ is 3 or 4;

$R^1$ is a $z^1$ valent hydrocarbon radical, substituted hydrocarbon radical, hydrocarbon radical containing at least one hetero atom or group, or substituted hydrocarbon radical containing at least one hetero atom or group, where $z^1=(q^2+q^1)-4$, with the proviso that if $b^1$ is zero than $q^2$ is 4 and if $b^1$ is zero than $q^1$ is 4.

$R^1$ generally contains from 1 to about 100, preferably 2 to about 50, carbon atoms and may be a divalent, trivalent, or tetravalent, i.e., $z^1$ is an integer having a value of from 2 to 4 inclusive, hydrocarbon radical, substituted hydrocarbon radical, hydrocarbon radical containing at least one hetero atom or group, or substituted hydrocarbon radical containing at least one hetero atom or group. The hydrocarbon radicals represented by $R^1$ may be aliphatic, either saturated or unsaturated, cycloalphatic, aromatic, or aliphatic-aromatic.

The dianhydrides of Formula VI wherein $R^1$ is a divalent radical may be represented by the Formula

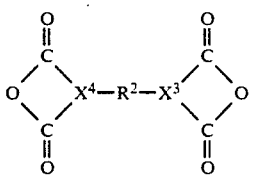

(VIa)

wherein:

$R^2$ is a divalent hydrocarbon radical, a substituted divalent hydrocarbon radical, a divalent hydrocarbon radical containing at least one hetero atom or group, or a substituted divalent hydrocarbon radical containing at least one hetero atom or group.

$X^3$ is a trivalent aliphatic acyclic hydrocarbon or substituted hydrocarbon radical containing from 2 to about 8 carbon atoms which together with the two carbonyl carbon atoms and the oxygen atom forms a cyclic structure; and $X^4$ is a trivalent aliphatic acyclic hydrocarbon or substituted hydrocarbon radical containing from 2 to about 8 carbon atoms which together with the two carbonyl carbon atoms and the oxygen atom forms a cyclic structure.

The divalent hydrocarbon radicals represented by $R^2$ contain from 1 to about 100, preferably 2 to about 50, carbon atoms and include the alkylene, alkenylene, cycloalkylene, cycloalkylidene, arylene, alkarylene and arylalkenylene radicals. The alkylene radicals contain from 1 to about 100 carbon, and preferably 2 to about 50, may be straight chain or branched. Typical cycloalkylene and cycloalkylidene radicals are there containing from 4 to about 16 ring carbon atoms. The cycloalkylene and cyclo-alkylidene radicals may contain substituent groups, e.g., lower alkyl groups, on one or more ring carbon atoms. When more than one substituent group is present they may be the same or different. Typical arylene radicals are those containing from 6 to 12 ring carbons, e.g., phenylene, naphthylene and biphenylene. Typical alkarylene and aralkylene radicals are those containing from 7 to about 50 carbon atoms.

The substituted divalent hydrocarbon radicals represented by $R^2$ are those divalent hydrocarbon radicals defined above which contain at least one substituent group, typically from 1 to about 5 substituent groups, of the type described hereinafore.

The divalent hydrocarbon radicals containing at least one hetero atom or group represented by $R^2$ are those divalent hydrocarbon radicals defined above which contain at least one hetero atom or group of the type defined hereinafore in the carbon chain.

Some illustrative non-limiting examples of dianhydrides of Formula VIa include

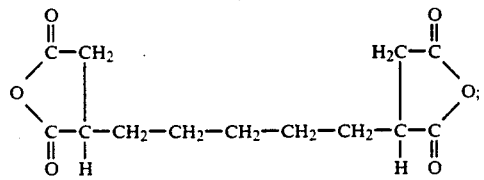

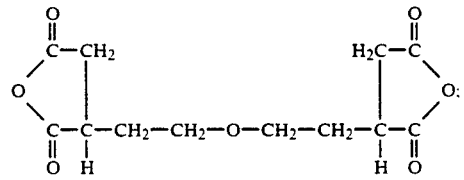

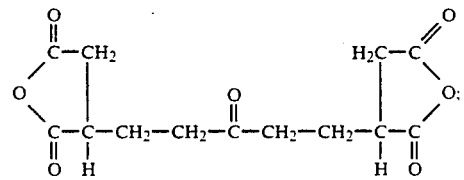

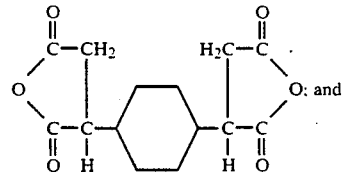

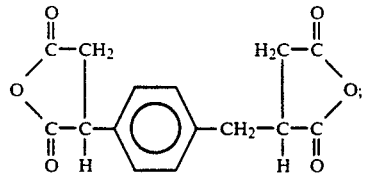

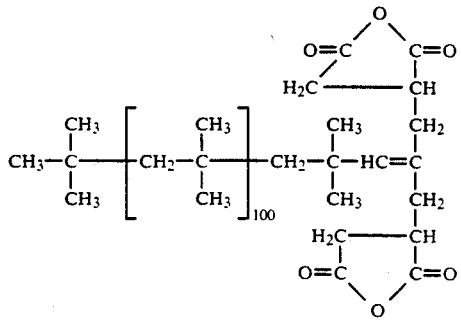

-continued

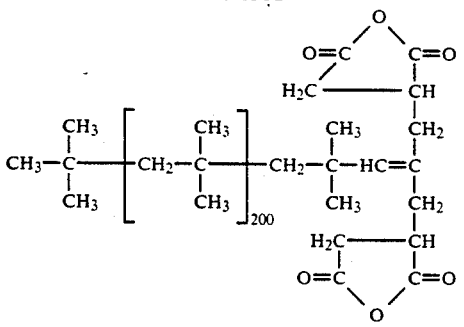

The dianhydrides of Formula VI wherein $R^1$ is a trivalent radical may he represented by the formulae

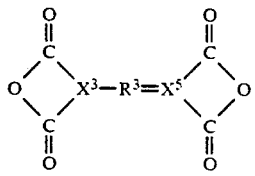

(VIb)

and

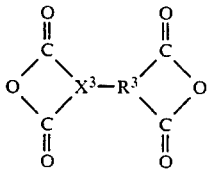

(VIb¹)

wherein $R^3$ is a trivalent hydrocarbon radical or a trivalent substituted hydrocarbon radical;

$X^5$ is a tetravalent aliphatic acyclic hydrocarbon or substituted hydrocarbon radical containing from 1 to about 8 carbon atoms which together with the carbonyl carbon atoms and the oxygen atom forms acyclic structure; and $X^3$ is as defined hereinafore.

The trivalent hydrocarbon radicals represented by $R^3$ in Formulae Vb and Vb¹ are trivalent cycloaliphatic or aromatic hydrocarbon radicals. The trivalent cycloaliphatic hydrocarbon radicals represented by $R^3$ preferably contain from 3 to about 16 ring carbon atoms. The trivalent aromatic hydrocarbon radicals represented by $R^3$ preferably contain from 6 to 12 ring carbon atoms. The trivalent substituted hydrocarbon radicals represented by $R^3$ are those trivalent hydrocarbon radicals described hereinafore which contain at least 1, preferably from 1 to about 4, substituent groups of the type described hereinafore on the ring carbon atoms.

The tetravalent aliphatic acyclic hydrocarbon radicals represented by $X^5$ Formula Vb are those containing from 1 to about 8 carbon atoms that together with the two carbonyl carbon atoms and the oxygen atom form a cyclic structure. These radicals include the alkanetetrayl radicals. The tetravalent substituted aliphatic acylic hydrocarbon radicals represented by $X^5$ in Formula VIb are those tetravalent aliphatic acyclic hydrocarbon radicals described hereinafore which contain at least one substituent group of the type described hereinafore.

Some illustrative non-limiting examples of the dianhydrides of Formulae VIb and VIb¹ include

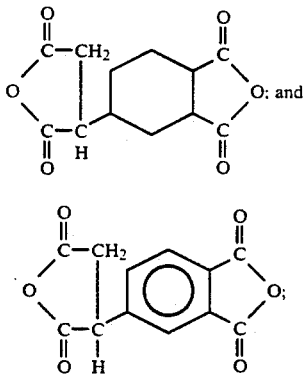

The dianhydrides of Formula VI wherein $R^1$ is a tetravalent radical may be represented by the formulae

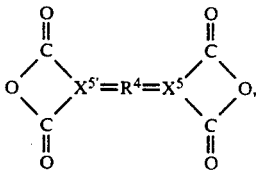

(VIc)

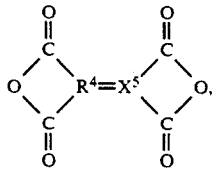

(VIc')

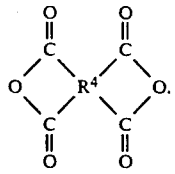

(VIc")

wherein:

$R^4$ is a tetravalent hydrocarbon radical or a tetravalent substituted hydrocarbon radical;

$X^5$ is a tetravalent aliphatic acyclic hydrocarbon or substituted hydrocarbon radical containing from 2 to about 8 carbon atoms which together with the carbonyl carbon atoms and the oxygen atom forms a cyclic $X^{5'}$ is a tetravalent aliphatic acyclic hydrocarbon or substituted hydrocarbon radical containing from 2 to about 8 carbon atoms which together with the carbonyl carbon atoms and the oxygen atom forms a cyclic structure.

The tetravalent hydrocarbon radicals represented by $R^4$ in Formulae VIc-VIc" are tetravalent cycloaliphatic or aromatic hydrocarbon radicals. The tetravalent cycloaliphatic or aromatic hydrocarbon radicals preferably contain from 4 to about 16 ring carbon atoms. The tetravalent aromatic hydrocarbon radicals preferably contain from 6 to 12 ring carbon atoms. The tetravalent substituted hydrocarbon radicals represented by $R^4$ are these tetravalent hydrocarbon radicals described above, which contain at least one substituent group of the type described hereinafore on at least one carbon atom.

Some illustrative non-limiting examples of the dianhydrides of Formulae VIc-VIc'' include

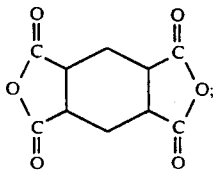

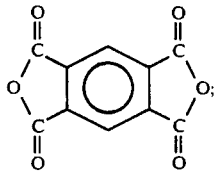

and

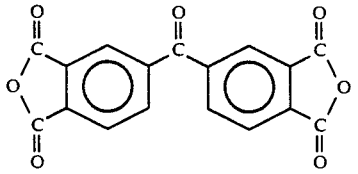

These polyanhydrides are reacted with the nitrogen or ester containing adducts selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; and (iii) Mannich condensation products formed by condensing a long chain hydrocarbon substituted hydroxy aromatic compound with an aldehyde and a polyamine, to form the improved dispersants of the present invention. In the case of nitrogen containing adducts these adducts that are further reacted with the polyanhydrides in accordance with the present invention contain sufficient unreacted residual reactive amino groups, i.e., primary and/or secondary amino groups, preferably secondary amino groups, to enable the desired reaction with the polyanhydrides to take place. This reaction involves the anhydride moieties of the polyanhydride and the reactive amino or hydroxyl moieties of the adduct whereby different molecules of the adduct are joined or coupled by anhydride moieties on the same polyanhydride molecule.

In a preferred embodiment the nitrogen containing adduct is of group (i). Such an adduct, as discussed hereinafore, may be characterized as an acylated nitrogen derivative of hydrocarbyl substituted dicarboxylic acid producing materials. While the following discussion is directed to this preferred embodiment, it is to be understood that, with minor modifications, it is equally applicable to the other adducts of groups (i)-(iii) which may be used in the instant invention.

The polyanhydrides of the present invention are reacted with the acylated nitrogen derivatives of hydrocarbyl substituted dicarboxylic acid materials. The acylated nitrogen derivatives that are further reacted with the polyanhydride in accordance with the present invention contain sufficient unreacted residual reactive amino nitrogens, e.g., secondary amino nitrogens, to enable the desired reaction with the polyanhydrides to take place. This reaction is between the remaining reactive nitrogens of the acylated nitrogen derivatives and the anhydride moieties of the polyanhydride whereby different molecules of the acylated nitrogen derivatives are joined or coupled by the anhydride moieties on the same polyanhydride molecule. That is to say different anhydride moieties on the same polyanhydride molecule react with amino groups on different molecules of the acylated nitrogen derivatives, thereby coupling or linking these different acylated nitrogen derivative molecules.

Reaction may be carried out by adding an amount of polyanhydride to the acylated nitrogen derivative which is effective to couple at least some of the molecules of the acylated nitrogen derivative. That is to say an amount of polyanhydride effective to form the dispersants of the instant invention. It will be apparent to those skilled in the art that the amount of polyanhydride utilized will depend upon (i) the number of reactive nitrogen atoms present in the acylated nitrogen derivative, (ii) the number of anhydride groups present in the polyanhydride, and (iii) the number of such groups which it is desired to react, i.e., the degree of coupling or cross-linking it is desired to obtain.

Generally, however, it is preferred to utilize an amount of polyanhydride such that there are present from about 0.05 to 10 equivalents of anhydride moiety per equivalent of reactive residual amino group in the acylated nitrogen derivative, preferably from about 0.1 to 5 equivalents of anhydride per equivalent of reactive amino group present in the acylated nitrogen derivative.

The temperature at which the reaction is carried out generally ranges from about 20° C. to the decomposition temperature of the mixture, preferably from about 50° C. to about 250° C., and more preferably from about 75° C., to about 200° C. While superatmospheric pressures are not excluded, the reaction generally proceeds at atmospheric pressure. The reaction may be conducted using a mineral oil, e.g., 100 neutral oil as a solvent. An inert organic co-solvent, e.g., xylene or toluene, may also be used.

The products of the instant invention are formed as a result of bonding, i.e., formation of an amide linkage, of different anhydride moieties on the same polyanhydride molecule with reactive secondary amino groups on different molecules of the acylated nitrogen derivative. The reaction and product may, for purposes of illustration and exemplification only, be represented by the following reaction between a dianhydride and 2 moles of an acylated nitrogen derivative of hydrocarbyl substituted dicarboxylic acid material containing only one reactive secondary amino group:

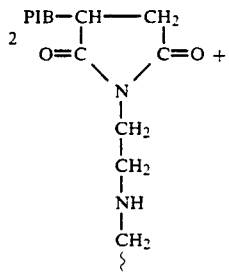

-continued

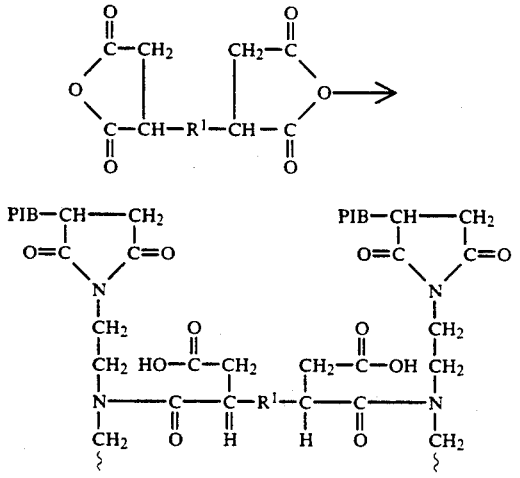

wherein PIB is a polyisobutylene and $R^1$ is a divalent hydrocarbon radical. This type of product is obtained from the reaction of an acylated nitrogen derivative containing only one residual reactive amino group per molecule, i.e., secondary amino group, and a dianhydride of Formula VI wherein $R^1$ is a divalent hydrocarbon radical, e.g., and alkylene radical. If the acylated nitrogen derivative contains more than one residual reactive amino group per molecule and/or the polyanhydride contains more than two anhydride groups per molecule then the products will be more complex.

Thus, for example, if three molecules of an acylated nitrogen derivative containing two secondary amino groups per molecule are reacted with two molecules of dianhydride the resulting products will include at least one compound represented by the formula

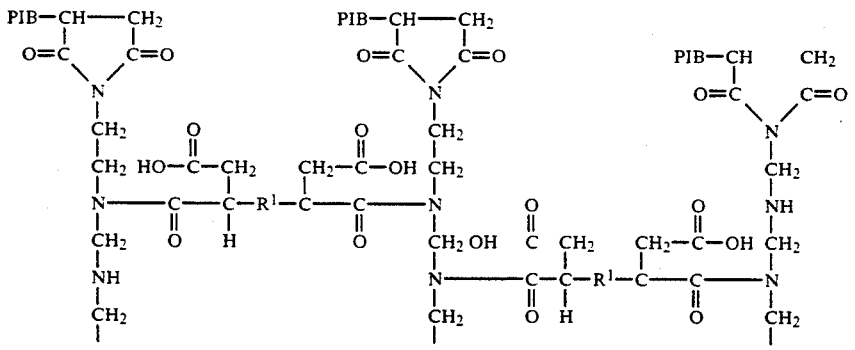

If, for example, 3 molecules of an acylated nitrogen derivative containing one secondary amino group per molecule are reacted with 1 molecule of a trianhydride the resulting products will include at least one compound represented by the formula

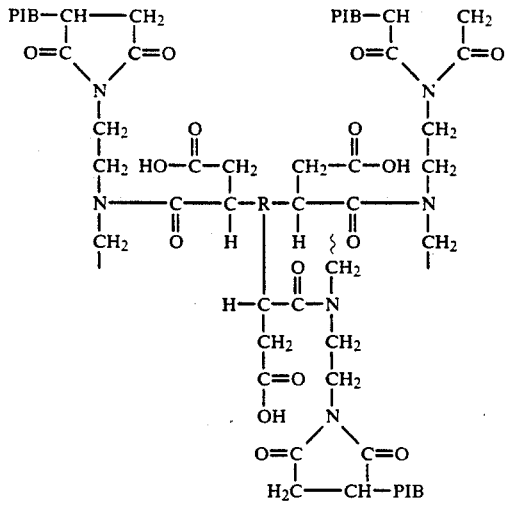

The polyanhydride is, in effect, a chain extender or cross-linking agent serving to join together two or more molecules of acylated nitrogen derivative. The product, since it contains two or more acylated nitrogen derivative molecules bonded together, has a higher molecular weight and may be characterized as an oligomer or even a polymer. The molecular weight of the product will depend, inter alia, upon the number of reactive amino groups per molecule of acylated nitrogen derivative, the number of anhydride groups per molecule of polyanhydride, and the amount of polyanhydride present in the reaction mixture of polyanhydride and acylated nitrogen derivative. For example, if an acylated nitrogen derivative containing only one residual reactive amino group, preferably a secondary amino group, per molecule is reacted with a dianhydride the product will+be a dimer of the acylated nitrogen derivative. In such a situation increasing the amount of the dianhydride will generally not result in an increase in the molecular weight of the resultant dimer molecule but will yield more dimer molecules. On the other hand, if an acylated nitrogen derivative containing more than one residual reactive amino group per molecule is reacted with a dianhydride, the molecular weight of the product molecule may be increased by the production of more chain-extended molecules.

As is readily apparent from the foregoing discussion and equations the products formed from the reaction of a dicarboxylic acid anhydride group of the polyanhydride with a secondary amino group of the nitrogen derivative of hydrocarbyl substituted dicarboxylic acid material include an amide group and a carboxyl group. The carboxyl group, while less reactive than a dicarboxylic acid anhydride group and generally requiring more extreme reaction conditions, e.g., higher temperatures, may nevertheless also react with a secondary amino group to form another amide group and thus bond yet another molecule of nitrogen derivative adduct to the polyanhydride molecule. Thus, it is possible, due to the formation of these carboxyl groups, for a single polyanhydride molecule such as a dianhydride molecule containing two dicarboxylic acid anhydride groups to link or join together four molecules of nitrogen derivative adduct. In such case there is generally a two stage reaction. The first stage, which proceeds quite readily, involves the reaction of the two relatively more reactive anhydride groups on the same molecule of the polyanhydride, i.e., dianhydride, with the secondary amino groups on two different molecules of nitrogen derivative adduct to form two amide bands between the dianhydride molecule and the nitrogen derivative molecules, and two carboxyl groups. The second stage involves reaction of the two carboxyl groups on the resulting adduct molecule with the secondary amino groups on yet another two different molecules of nitrogen derivative adduct to form yet another two amide bonds between the polyanhydride molecule and these two additional nitrogen derivative adduct molecules, thus bonding two further adduct molecules. This second stage is more difficult and generally requires more extreme reaction conditions than the first stage.

Further aspects of the present invention reside in the formation of metal complexes and other post-treatment derivatives, e.g., borated derivatives, of the novel additives prepared in accordance with this invention. Suitable metal complexes may be formed in accordance with known techniques of employing a reactive metal ion species during or after the formation of the present dispersant materials. Complex-forming metal reactants include the nitrates, thiocyanates, halides, carboxylates, phosphates, thio-phosphates, sulfates, and borates of transition metals such as iron, cobalt, nickel, copper, chromium, manganese, molybdenum, tungsten, ruthenium, palladium, platinum, cadmium, lead, silver, mercury, antimony and the like. Prior art disclosures of these complexing reactions may be found in U.S. Pat. Nos. 3,306,908 and Re. 26,443.

Post-treatment compositions include those formed by reacting the novel additives of the present invention with one or more post-treating reagents, usually selected from the group consisting of boron oxide, boron oxide hydrate, boron halides, boron acids, sulfur, sulfur chlorides, phosphorous sulfides and oxides, carboxylic acid or anhydride acylating agents, epoxides and episulfides and acrylonitriles. The reaction of such post-treating agents with the novel additives of this invention is carried out using procedures known in the art. For example, boration may be accomplished in accordance with the teachings of U.S. Pat. No. 3,254,025 by treating the additive compound of the present invention with a boron oxide, halide, ester or acid. Treatment may be carried out by adding about 1-3 wt. % of the boron compound, preferably boric acid, and heating and stirring the reaction mixture at about 135° C. to 165° C. for 1 to 5 hours followed by nitrogen stripping and filtration, if desired. Mineral oil or inert organic solvents facilitate the process.

The compositions produced in accordance with the present invention are useful as fuel and lubricating oil additives, particularly dispersant additives.

When the compositions of this invention are used in normally liquid petroleum fuels, such as middle distillates boiling from about 150° to 800° F. including kerosene, diesel fuels, home heating fuel oil, jet fuels, etc., a concentration of the additive in the fuel in the range of typically from 0.001 wt. % to 0.5 wt. %, preferably 0.005 wt. % to 0.2 wt. %, based on the total weight of the composition, will usually be employed. These additives can contribute fuel stability as well as dispersant activity and/or varnish control behavior to the fuel.

The compounds of this invention find their primary utility, however, in lubricating oil compositions, which employ a base oil in which the additives are dissolved or dispersed. Such base oils may be natural or synthetic.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular polymer adduct hereof, if desired.

Accordingly, while any effective amount of these additives can be incorporated into the fully formulated lubricating oil composition, it is contemplated that such effective amount be sufficient to provide said lube oil composition with an amount of the additive of typically from 0.01 to about 10, e.g., 0.1 to 6.0, and preferably from 0.25 to 3.0 wt. %, based on the weight of said composition.

The additives of the present invention can be incorporated into the lubricating oil in any convenient way. Thus, they can be added directly to the oil by. dispersing, or dissolving the same in the oil at the desired level of concentration, typically with the aid of a suitable solvent such as toluene, cyclohexane, or tetrahydrofuran. Such blending can occur at room temperature or elevated.

Natural base oils include mineral lubricating oils which may vary widely as to their crude source, e.g., whether paraffinic, naphthenic, mixed, paraffinic-naphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 2.5 to about 9 cSt. at 100° C.

Thus, the additives of the present invention can be employed in a lubricating oil composition which comprises lubricating oil, typically in a major amount, and the additive, typically in a minor amount, which is effective to impart enhanced dispersancy relative to the absence of the additive. Additional conventional additives selected to meet the particular requirements of a temperatures. In this form the additive per se is thus being utilized as a 100% active ingredient form which can 1 added to the oil or fuel formulation by the purchase: Alternatively, these additives may be blended with suitable oil-soluble solvent and base oil to form concentrate, which may then be blended with a lubricating oil base stock to obtain the final formulation Concentrates will typically contain from about 2 to 80 wt. %, by weight of the additive, and preferably from about 5 to 40% by weight of the additive.

The lubricating oil base stock for the additive of the present invention typically is adapted to perform selected function by the incorporation of additives therein to form lubricating oil compositions (i.e., formulations).

Representative additives typically present in such formulations include viscosity modifiers, corrosion inhibitors, oxidation inhibitors, friction modifiers, other dispersants, anti-foaming agents, anti-wear agents, pour point depressants, detergents, rust inhibitors and the like.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have weight average molecular weights of from about 10,000 to 1,000,000, preferably 20,000 to 500,000, as determined by gel permeation chromatography or light scattering methods.

Representative examples of suitable viscosity modifiers are any of the types known to the art including polyisobutylene, copolymers of ethylene and propylene,. polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/-butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at temperature in the range of about 66 to about 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e.g., calcium nonylphenol sulfide, barium toctylphenylsulfide, dioctylphenylamine, phenylalphanaphthylamine, phosphosulfurized or sulfurized hydrocarbons, etc.

Other oxidation inhibitors or antioxidants useful in this invention comprise oil-soluble copper compounds. The copper may be blended into the oil as any suitable oil soluble copper compound. By oil soluble it is meant that the compound is oil soluble under normal blending conditions in the oil or additive package. The copper compound may be in the cuprous or cupric form. The copper may be in the form of the copper dihydrocarbyl thio- or dithio-phosphates. Alternatively, the copper may be added as the copper salt of a synthetic or natural carboxylic acid. Examples of same thus include $C_{10}$ to $C_{18}$ fatty acids, such as stearic or palmitic acid, but unsaturated acids such as oleic or branched carboxylic acids such as napthenic acids of molecular weights of from about 200 to 500, or synthetic carboxylic acids, are preferred, because of the improved handling and solubility properties of the resulting copper carboxylates. Also useful are oil-soluble copper dithiocarbamates of the general formula $(RR,NCSS)_nCu$ where n is 1 or 2 and R and R, are the same or different hydrocarbyl radicals containing from 1 to 18, and preferably 2 to 12, carbon atoms, and including radicals such as alkyl, alkenyl, aryl, aralkyl, alkaryl and cycloaliphatic radicals. Particularly preferred as R and R, groups are alkyl groups of from 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., R and R,) will generally be about 5 or greater. Copper sulphonates, phenates, and acetylacetonates may also be used.

Exemplary of useful copper compounds are copper $CU^{I}$ and/or $Cu^{II}$ salts of alkenyl succinic acids or anhydrides. The salts themselves may be basic, neutral or acidic. They may be formed by reacting (a) polyalkylene succinimides (having polymer groups of $M_n$ of 700 to 5,000) derived from polyalkylene-polyamines, which have at least one free carboxylic acid group, with (b) a reactive metal compound. Suitable rective metal compounds include those such as cupric or cuprous hydroxides, oxides, acetates, borates, and carbonates or basic copper carbonate.

Examples of these metal salts are Cu salts of polyisobutenyl succinic anhydride, and Cu salts of polyisobutenyl succinic acid. Preferably, the selected metal employed is its divalent form, e.g., Cu+2. The preferred substrates are polyalkenyl succinic acids in which the alkenyl group has a molecular weight greater than about 700. The alkenyl group desirably has a $M_n$ from about 900 to 1,400, and up to 2,500, with a Mn of about 950 being most preferred. Especially preferred is polyisobutylene succinic anhydride or acid. These materials may desirably be dissolved in a solvent, such as a mineral oil, and heated in the presence of a water solution (or slurry) of the metal bearing material. Heating may take place between 70° and about 200° C. Temperatures of 110° C. to 140° C. are entirely adequate it may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-polyisobutenyl succinic anhydride, Cu-oleate, or mixtures thereof) will be generally employed in an amount of from about 50 to 500 ppm by weight of the metal, in the final lubricating or fuel composition.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures thereof; U.S. Pat. No. 3,879,306 which discloses N(hydroxyalkyl)alkenylsuccinamic acids or succinimides: U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobis-alkanols such as described in U.S. Pat. No. 4,344,1153.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Pour point depressants, otherwise known as lube oil flow improvers, lower the temperature at which the fluid will flow or can be poured. Such additives are well known. Typically of those additives which usefully optimize the low temperature fluidity of the fluid are. $C_8$-$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (viz. overbased) metal sales, such as highly basic alkaline earth metal sulfonates (especially Ca and Mg salts) are frequently used as detergents. Representative examples of such materials, and their methods of preparation, are found in copending U.S. Ser. No. 754,001, filed Jul. 11, 1985, the disclosure of which is hereby incorporated by reference.

Some of these numerous additives can provide a multiplicity of effects, e.g., a dispersant-oxidation inhibitor. This approach is well known and need not ne further elaborated herein.

Compositions when containing these conventional additives are typically blended into the base oil in amounts which are effective to provide their normal attendant function. Representative effective amounts of such additives are illustrated as follows:

| Additive | Wt. % a.i. (Broad) | Wt. % a.i. (Preferred) |
|---|---|---|
| Viscosity Modifier | .01-12 | .01-4 |
| Corrosion Inhibitor | 0.01-5 | .01-1.5 |
| Oxidation Inhibitor | 0.01-5 | .01-1.5 |
| Dispersant | 0.1-20 | 0.1-8 |
| Pour Point Depressant | 0.01-5 | .01-1.5 |
| Anti-Foaming Agents | 0.001-3 | .001-0.15 |
| Anti-Wear Agents | 0.001-5 | .001-1.5 |
| Friction Modifiers | 0.01-5 | .01-1.5 |
| Detergents/Rust Inhibitors | .01-10 | .01-3 |
| Mineral Oil Base | Balance | Balance |

When other additives are employed, it may be desirable, although not necessary, to prepare additive concentrates comprising concentrated solutions or dispersions of the dispersant (in concentrate amounts hereinabove described), together with one or more of said other additives (said concentrate when constituting an additive mixture being referred to herein as an additive package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the dispersant additive and optional additional additives in proper amounts to provide the desired concentration in the final formulation when the additive-package is combined with a predetermined amount of base lubricant. Thus, the products of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt. % of the additive-package with the remainder being base oil.

All of said weight percents expressed herein are based on active ingredient (a.i.) content of the additive, and/or upon the total weight of any additive-package, or formulation which will be the sum of the a.i. weight of each additive plus the weight of total oil or diluent.

This invention will be further understood by reference to the following examples, wherein all parts are parts by weight and all molecular weights are number weight average molecular weights as noted, and which include preferred embodiments of the invention.

The following examples illustrate the dispersants of the instant invention.

EXAMPLE 1

About 160 grams of a polyisobutenyl succinic anhydride (70% active ingredient and comprised of the reaction product of maleic anhydride and polyisobutene having a $\overline{M}_n$ of about 940, said reaction product having a saponification number of 70, and a ratio of succinic anhydride to polyisobutene of 0.6:1) are charged into a reaction vessel and heated to 160 C while under a nitrogen blanket. Then 14.5 grams of tetraethylene pentamine are added during a 10 minute period. The reaction mixture is stripped with nitrogen at 160 C for 2 hours. About 50 grams of this polyisobutenyl succinic anhydride-tetraethylene pentamine product are mixed with 3.54 grams of 3,3', 4,4',-benzophenone tetracarboxylic dianhydride and the resulting reaction mixture is heated at 160 C for one hour while stirring under a nitrogen atmosphere. The reaction mixture is then stripped with nitrogen for one hour at 160 C. The product is allowed to cool to about 60 C and is then dissolved in 200 ml. of heptane. The heptane solution is filtered and the filtrate is vacuum stripped. The product is analyzed for nitrogen and contains 2.58% nitrogen.

EXAMPLE 2

About 100 grams of the polyisobutenyl succinic anhydride used in Example 1 are charged into a reactor vessel and heated to 160 C while under a nitrogen blanket. Then 11.8 grams of tetraethylene pentamine are added during a 10 minute period. The reaction mixture is stripped with nitrogen at 160 C for 2 hours. About 30 grams of this polyisobutenyl succinic anhydride-tetraethylene pentamine product are mixed with 1.76 grams of 3,3', 4,4'-benzophenone tetracarboxylic dianhydride and the resulting reaction mixture is heated at 160 C for 2 hours while stirring under a nitrogen atmosphere. The reaction mixture is then stripped with nitrogen for one hour at 160 C. The product is allowed to cool to about 60 C and is then dissolved in 200 ml. of heptane. The heptane solution is filtered and the filtrate is vacuum stripped. The product is analyzed for nitrogen and contains 2.59% nitrogen.

EXAMPLE 3

Into a reactor vessel are charged 300 grams of polyisobutenyl succinic anhydride-polyamine adduct (comprising the reaction product of a polyamine with a succinic anhydride grafted polyisobutene, the polyisobutenyl succinic anhydride having a ratio of about 1.1 succinic anhydride moieties per polyisobutene moiety of about 2,200 $\overline{M}_n$, and the polyamine being a polyethylene polyamine having from about 5 to 7 nitrogens),. 300 grams of S15ONR mineral oil, and 6.1 grams of 1,2,4,5-benzenetetracarboxylic acid dianhydride. This reaction mixture is heated, with stirring, under a nitrogen sparge at 175 C for 3 hours. The oil solution containing the product is cooled and filtered. The filtered mineral oil solution of the product has a viscosity at 100 C of 170.8 centistokes. In comparison an oil solution containing 100 grams of S15ONR mineral oil and 100 grams of said polyisobutenyl succinic anhydride-polyamine adduct has a viscosity at 100 C of 75.3 centistokes.

EXAMPLE 4

The procedure of Example 3 is substantially repeated with the exception that 12.2 grams of the 1,2,4,5-benzenetetracarboxylic acid dianhydride are utilized. The filtered mineral oil solution of the product has a viscosity at 100 C of 177.0 centistokes.

The following two examples illustrate the preparation of some substituted dianhydrides of the instant invention.

EXAMPLE 5

Into a reactor vessel are added 2,000 grams of polyisobutene having a $\overline{M}_n$ of 320. During a 5 hour period the temperature is raised from 120° C. to 220° C. while adding maleic anhydride at a rate of 245 grams per hour (for a total of 1,225 grams of maleic anhydride), and introducing chlorine into the reaction mixture at a rate of 162.48 grams per hour. At the end of this 5-hour period the reaction mixture is maintained at a temperature of 220° C. for one hour while the introduction of chlorine at the rate of 162.48 grams per hour is continued. The reaction mixture is then soaked for an additional hour at 220° C. and stripped with nitrogen for one-half hour. The resultant product has a saponification number of 368.55, and has an average of about 1.54 anhydride moieties per polyisobutene moiety.

EXAMPLE 6

Into a reactor vessel are added 2,000 grams of polyisobutene having a $\overline{M}_n$ of 450. During a 5-hour period the temperature is raised from 120° C. to 220° C. while adding maleic anhydride at a rate of 174.2 grams per hour (for a total of 871.1 grams of maleic anhydride), and introducing chlorine with the reaction mixture at a rate of 115.53 grams per hour. At the end of this 5 hour period the reaction mixture is maintained at a temperature of 220° C. for one hour while the introduction of chlorine at the rate of 115.53 grams per hour is continued. The reaction mixture is then soaked for an additional hour and stripped with nitrogen for one-half hour. The resultant product has a saponification number of 315.08, and has an average of about 1.73 anhydride moieties per polyisobutene moiety.

The following four examples further illustrate the dispersants of the instant invention.

EXAMPLE 7

The procedure of Example 3 is substantially repeated except that the 6.1 grams of the 1,2,4,5-benzenetetracarboxylic acid dianhydride of Example 3 are replaced with 8.5 grams of the dianhydride of Example 5. The resultant oil solution of the product has a viscosity at 100° C. of 98.61 centistokes.

EXAMPLE 8

The procedure of Example 3 is substantially repeated except that the 6.1 grams of the 1,2,4,5-benzenetetracarboxylic acid dianhydride of Example 3 are replaced with 17.0 grams of the dianhydride of Example 5. The resultant oil solution of the product has a viscosity at 100° C. of 135.4 centistokes.

EXAMPLE 9

The procedure of Example 3 is substantially repeated except that the 6. 1 grams of the 1,2,4,5-benzenetetracarboxylic acid dianhydride of Example 3 are replaced with 10 grams of dianhydride of Example 6. The resultant oil solution of the product has a viscosity at 100° C. of 103.5.

EXAMPLE 10

The procedure of Example 3 is substantially repeated except that the 6.1 grams of the 1,2,4,5-benzenetetracarboxylic acid dianhydride of Example 3 are replaced with 20 grams of the dianhydride of Example 6. The resultant oil solution of the product has a viscosity at 100° C. of 127.3 centistokes.

As can be seen from these examples the reaction of a dianhydride with the polyisobutenyl succinic anhydride-polyamine results in a product having a higher viscosity that that of the polyisobutenyl succinic anhydride-polyamine adduct or reaction product.

It is to be understood that the examples present in the foregoing specification are merely illustrative of this invention and are not intended to limit it in any manner.

We claim:

1. An oleaginous composition comprising:

(A) oleaginous material selected from the group consisting of fuels; and (B) oil soluble composition comprising reaction product of:

(1) at least one oil soluble Mannich condensation product formed by condensing long chain hydrocarbyl substituted hydroxyaromatic compound with aldehyde and polyamine, said Mannich condensation product containing at least one reactive amino group, and (2) at least one polyanhydride.

2. The composition according to claim 1 wherein said long chain hydrocarbyl in (B)(1) is a polymer of at least one $C_2$ to $C_{18}$ monoolefin, said polymer having a number average molecular weight of from about 500 to about 6,000.

3. The composition according to claim 2 wherein (B)(1) is comprised of reaction product of (a) at least one polyamine containing at least two active amino groups selected from primary amino groups and secondary amino groups, (b) at least one long chain hydrocarbyl substituted hydroxyaromatic compound, and (c) at least one aldehyde.

4. The composition according to claim 3 wherein (B)(1) is comprised of Mannich condensation product formed by condensing (a) about 0.05 to 2 moles of polyamine, (b) about 1 mole of long chain hydrocarbyl substituted hydroxy aromatic compound, and (c) about 1 to 2.5 moles of aldehyde.

5. The composition according to claim 3 wherein said long chain hydrocarbyl substituted hydroxyaromatic compound is long chain hydrocarbyl substituted phenol.

6. The composition according to claim 5 wherein said long chain hydrocarbyl is polyalkenyl.

7. The composition according to claim 5 wherein said aldehyde (B)(1)(c) is formaldehyde.

8. The composition according to claim 5 wherein said aldehyde (B)(1)(c) is paraformaldehyde.

* * * * *